US005393247A

United States Patent [19]

DiOrazio et al.

[11] Patent Number: 5,393,247

[45] Date of Patent: Feb. 28, 1995

[54] COMPONENT MOUNTING DEVICE

[75] Inventors: Joseph S. DiOrazio, Harrisburg; Douglas R. Sarver, Millerstown, both of Pa.

[73] Assignee: The Whitaker Corporation, Wilmington, Del.

[21] Appl. No.: 217,045

[22] Filed: Mar. 23, 1994

[51] Int. Cl.[6] ..... H01R 13/73

[52] U.S. Cl. ..... 439/567; 411/510

[58] Field of Search ..... 439/567, 571; 411/508–510, 913; 24/297

[56] References Cited

U.S. PATENT DOCUMENTS

| | | | |
|---|---|---|---|
| D. 299,004 | 12/1988 | Fujimoto | D8/382 |
| 3,577,603 | 5/1971 | Seckerson et al. | 24/73 |
| 3,659,243 | 4/1972 | Gluntz | 439/525 |
| 3,778,755 | 12/1973 | Marks | 439/853 |
| 4,186,982 | 2/1980 | Cobaugh et al. | 439/82 |
| 4,435,031 | 3/1984 | Black et al. | 439/567 |
| 4,461,537 | 7/1984 | Raymer, II et al. | 350/96.2 |
| 4,477,142 | 10/1984 | Cooper et al. | 439/567 |
| 4,495,548 | 1/1985 | Matsui | 361/413 |
| 4,639,066 | 1/1987 | Shimamiya et al. | 439/569 |
| 4,668,040 | 5/1987 | Matsuzaki et al. | 439/571 |
| 4,679,883 | 7/1987 | Assini et al. | 439/607 |
| 4,693,532 | 9/1987 | Colleran et al. | 439/594 |
| 4,717,219 | 1/1988 | Frantz et al. | 439/82 |
| 4,721,473 | 1/1988 | DelGuidice et al. | 439/79 |
| 4,735,587 | 4/1988 | Kirayogula | 439/751 |
| 4,820,180 | 4/1989 | Mosquera et al. | 439/248 |
| 4,824,398 | 4/1989 | Taylor | 439/557 |
| 4,842,552 | 6/1989 | Frantz | 439/557 |
| 4,847,588 | 7/1989 | Doutrich | 439/751 |
| 4,907,987 | 3/1990 | Douty et al. | 439/571 |
| 5,074,807 | 12/1991 | Parmer | 439/567 |
| 5,108,308 | 4/1992 | Northcraft et al. | 439/571 |
| 5,135,412 | 8/1992 | Sitzler | 439/571 |
| 5,145,407 | 9/1992 | Obata et al. | 439/567 |
| 5,145,408 | 9/1992 | Houtteman et al. | 439/581 |
| 5,154,634 | 10/1992 | Brown et al. | 439/553 |
| 5,161,999 | 11/1992 | Broschard, III et al. | 439/567 |
| 5,163,851 | 11/1992 | Hart et al. | 439/567 |
| 5,171,165 | 12/1992 | Hwang | 439/567 |
| 5,176,349 | 1/1993 | Bendorf | 248/220.2 |
| 5,228,870 | 7/1993 | Gorenc et al. | 439/571 |
| 5,244,414 | 9/1993 | Peloza | 439/567 |

FOREIGN PATENT DOCUMENTS

| | | |
|---|---|---|
| 0180284 | 5/1986 | European Pat. Off. . |
| 2386963 | 4/1977 | France . |
| 7914042 | 5/1979 | Germany . |
| 40-22823 | 8/1940 | Japan . |
| 5183793 | 7/1976 | Japan . |
| 1128404 | 9/1968 | United Kingdom . |
| 2058485A | 4/1981 | United Kingdom . |
| 2239135A | 6/1991 | United Kingdom . |

*Primary Examiner*—Gary F. Paumen

*Attorney, Agent, or Firm*—Katherine A. Nelson

[57] ABSTRACT

A device 10 for holding an electrical connector 50 to a circuit board, the device 10 including a one-piece essentially planar metal member 12 with a pair of diverging cantilevered first beams 20 extending outwardly in a first direction from one body edge 14 and a pair of diverging cantilevered second beams 30 extending outwardly in a second direction from the other edge 14 of the body 12. Each of the pair of second beams 30 includes a wall engaging portion 40 at the leading ends thereof and a board holding portion 36 intermediate the wall engaging portion 40 and the body 12. The pair of first beams 20 are compressible toward one another and are adapted to be received in a cavity 58 of the electrical connector housing 52 and define a holding section for the connector 50. The pair of second beams 30 are being compressible toward one another and are adapted to be received in and cooperate with a corresponding retention aperture 84 of circuit board 80. The wall engaging surfaces 36 bear against aperture surfaces 86 to hold the connector 50 to the board 80.

5 Claims, 5 Drawing Sheets

COMPONENT MOUNTING DEVICE

FIELD OF THE INVENTION

This invention relates to a mounting device for locking or securing components such as electrical connectors to circuit boards.

BACKGROUND OF THE INVENTION

There are numerous ways of securing an electrical connector to a circuit board. For example, the connector may be provided with mounting flanges having bores that align with corresponding apertures of the circuit board. Threaded fasteners can be extended through the bore and board aperture. In other arrangements, such as disclosed in U.S. Pat. No. 5,228,870, one portion of a holding device is inserted into a recess of the housing flange from the connector mounting surface and a second portion of the device is inserted into the board aperture. The portions are provided with barbs and the recess and board aperture are sized for an interference fit with the barbs. U.S. Pat. No. 5,074,807 is directed to component holding devices for mounting electrical connectors to each other and to circuit boards. One of the embodiments of the device is a stamped H-shaped member having outwardly extending barbs along the outer edges of the two pairs of vertically extending essentially parallel projections or legs, one pair of the projections being received in a housing cavity and the other pair of projections being received in an aperture of a circuit board. The width of the projection may be varied to accommodate different geometries of housing recesses and circuit board apertures. When inserting the H-shaped device, the projections or legs are slightly deflected toward each other to be received in the recess or aperture and upon mounting the connector to the board, the projections returning substantially to the original shape after the holding device is fully engaged in the respective recess or aperture.

In mounting components to boards, it is desirable to minimize the outer envelope of the connector to reduce board space. It is also desirable to have a connector of reduced size that self aligns as it is mounted to the board. It is further desirable to have a holding device that is widely tolerant of dimensional variations in sizes of mounting apertures for the holding device.

SUMMARY OF THE INVENTION

Accordingly, the holding device of the present invention is a one piece essentially planar metal member having a body portion, a pair of diverging cantilevered first beams extending outwardly in a first direction in the plane from the body portion to first free ends and a pair of diverging cantilevered second beams extending outwardly in a second direction in the plane from the body portion to second free ends. The first beams are deflectable toward one another and are adapted to be received in a cavity within an electrical connector housing with side edges of the first beams bearing against sidewall surfaces of the cavity. Each of the pair of second beams include a wall engaging portion at the leading end thereof and a board holding portion intermediate the wall engaging portion and the body. The second beams are deflectable toward one another and are adapted to be received in the retention aperture of a circuit board with side edges of the second beams bearing against side wall surfaces of the apertures and to exert force against the sidewall aperture surfaces, thereby securing the connector to a board.

When at least two of the holding devices are used in an electrical connector the devices can also be used to align the connector in a desired location on the board. This is particularly useful when the devices are used with connectors having terminal leads that are to be received in circuit board apertures. To function as a means of alignment for the connector, the pair of second beams must extend below the ends of terminal leads such that the leading ends of the holding devices are received into apertures on the circuit board prior to insertion of the leads into their respective apertures. As the connector is mounted to the board the wall engaging portions of the second beams engage the walls of the holding device apertures of the board, thereby positioning the connector. The wall engaging portions are essentially straight and cause only a minimal insertion force as the terminal leads are moved into their respective terminal-receiving apertures. As the connector is moved into position, the insertion force increases as the holding section of the second cantilevered beams enter the aperture. The holding device is also suitable for use with connectors having surface mount terminals wherein the beams again position the connector such that the terminals are aligned with respective circuit pads.

Accordingly it is an object of the present invention to provide a mounting device for mounting electrical connectors to a circuit board that tolerates a larger range of hole sizes while providing an essentially consistent insertion and extraction forces.

It is another object of the invention to provide a board locking device that also provides alignment of connector solder tails to circuit board apertures before the insertion forces are encountered.

It is also an object of the invention to provide a connector with a holding device wherein the outer envelope of the connector is minimized to reduce board space.

It is another object to provide a connector of reduced size that self aligns as it is mounted to the board.

DETAILED DESCRIPTION OF THE DRAWINGS

Figure 1:
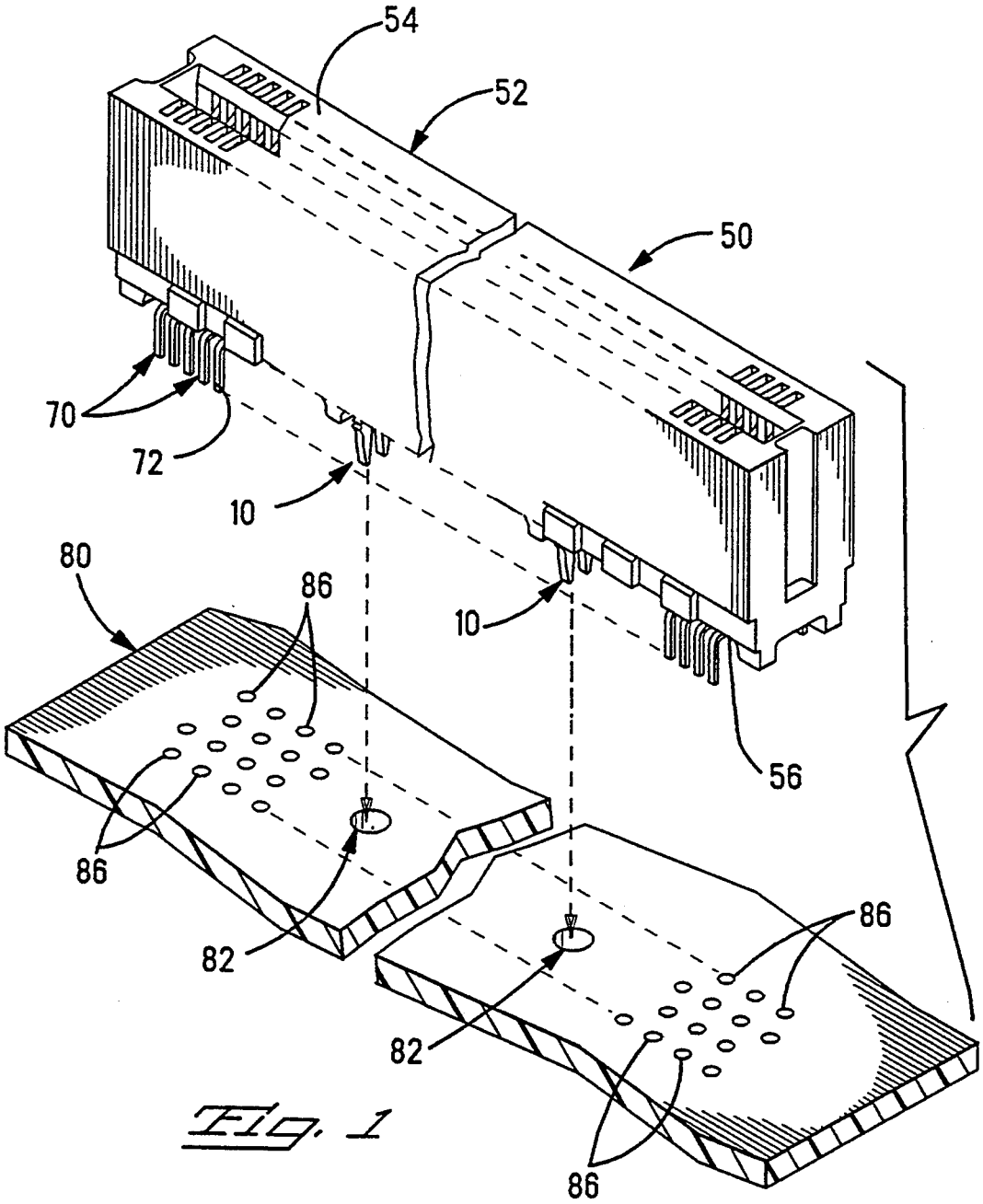
FIG. 1 is a perspective view of an electrical connector having two of the holding devices of the present invention with the connector exploded from the circuit board.
Figure 2:
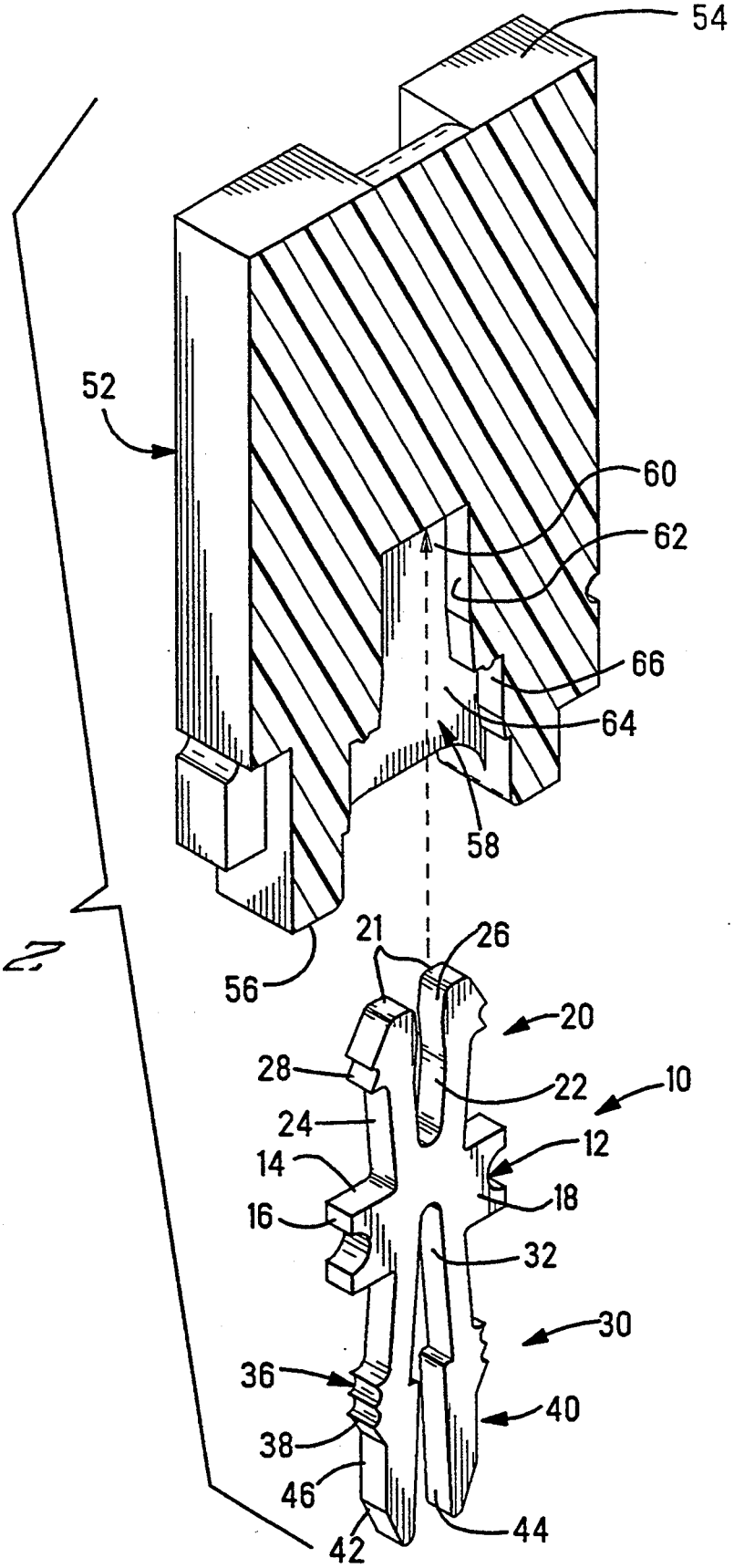
FIG. 2 is a sectional view of the connector of FIG. 1 showing the holding device exploded from the cavity within the housing.
Figure 3:
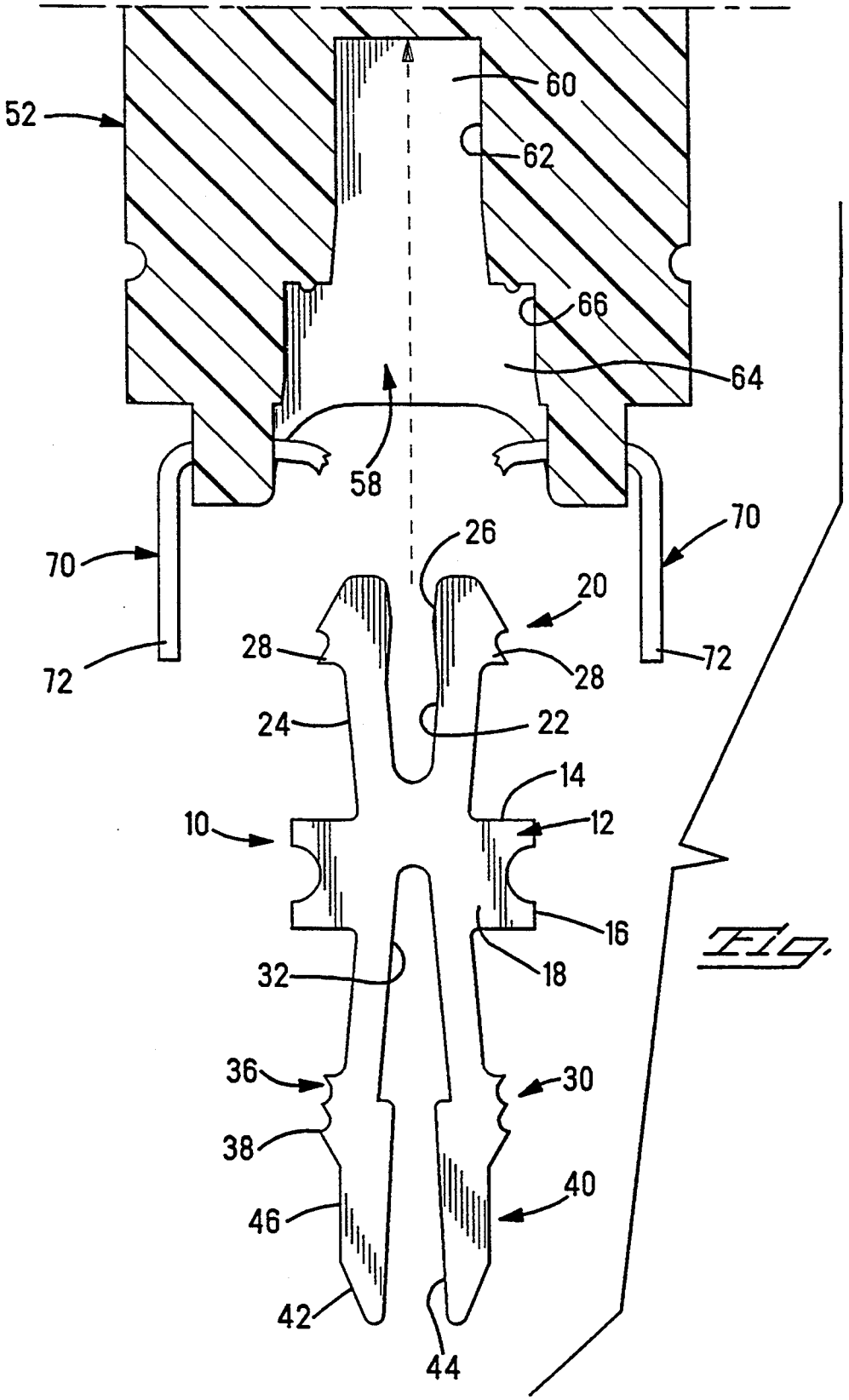
FIG. 3 is an enlarged fragmentary cross-sectional view of the housing illustrating the housing cavity and terminal leads with the holding device in position for insertion into the housing.

Referring now to FIGS. 1, 2 and 3 the component holding device 10 in accordance with the invention is designed for holding an electrical connector 50 to a circuit board 80. Holding device 10 includes a holding section 20 receivable in a cavity 58 in component housing 52 and a second holding portion 36 which is received in mounting apertures 82 of board 80. In the preferred embodiment thereof, the device 10 further aids an aligning terminal leads 70 of the connector 50 with corresponding terminal receiving apertures 86 in the circuit board 80. Holding device 10 is a one-piece essentially planar metal member including a body 12 having opposed lateral edges 14 and opposed end edges 16, a pair of diverging cantilevered first beams 20 extending outwardly in a first direction in the plane from one of the lateral edges to first free ends 21 and a pair of diverging cantilevered second beams 30 extending outwardly in a second direction in the plane from the other the lateral body edges 14 to second free ends 40. The pair of diverging cantilevered first beams 20 define a holding section for a first electrical component such as an electrical connector 50. The pair of diverging cantilevered second beams 30 define a board holding portion 36.

In accordance with the invention, only one holding device 10 is required to hold a connector to a board. Device 10 when used in pairs, however, also provides a means for aligning a connector on a board. This feature is particularly advantageous when it is difficult or virtually impossible to visually align the leads and/or the holding devices with their respective apertures, a situation known in the art as "blind mounting."

Connector 50 includes housing 52 having opposed mating and mounting faces 54,56 and two holding devices 10. Housing 52 includes a holding device cavity 58, for each holding device 10, as best seen in FIG. 2. As can be seen from FIG. 1, mounting or holding devices 10 are located within the envelope of the connector housing 52 thereby eliminating the need for mounting flanges for securing the connector 50 to board 80.

Figure 5:
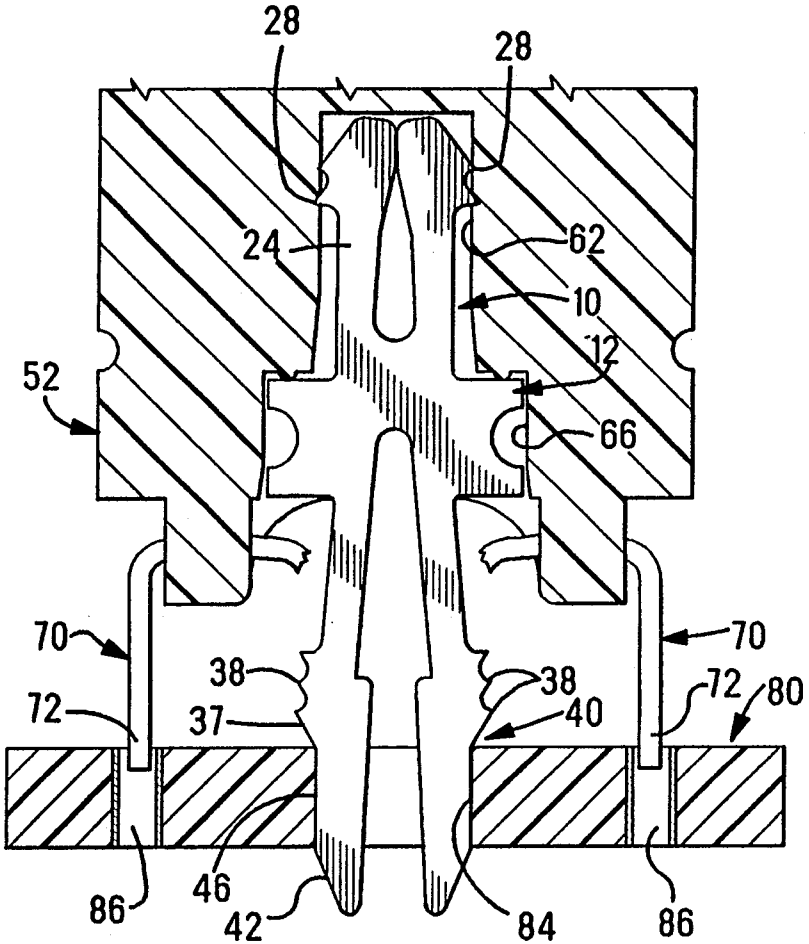
FIGS. 4, 5 and 6 are cross-sectional views of the device secured in the housing sequentially illustrating the movement of the board mounting portion of the device and as the connector is mounted to the board.
Figure 4:
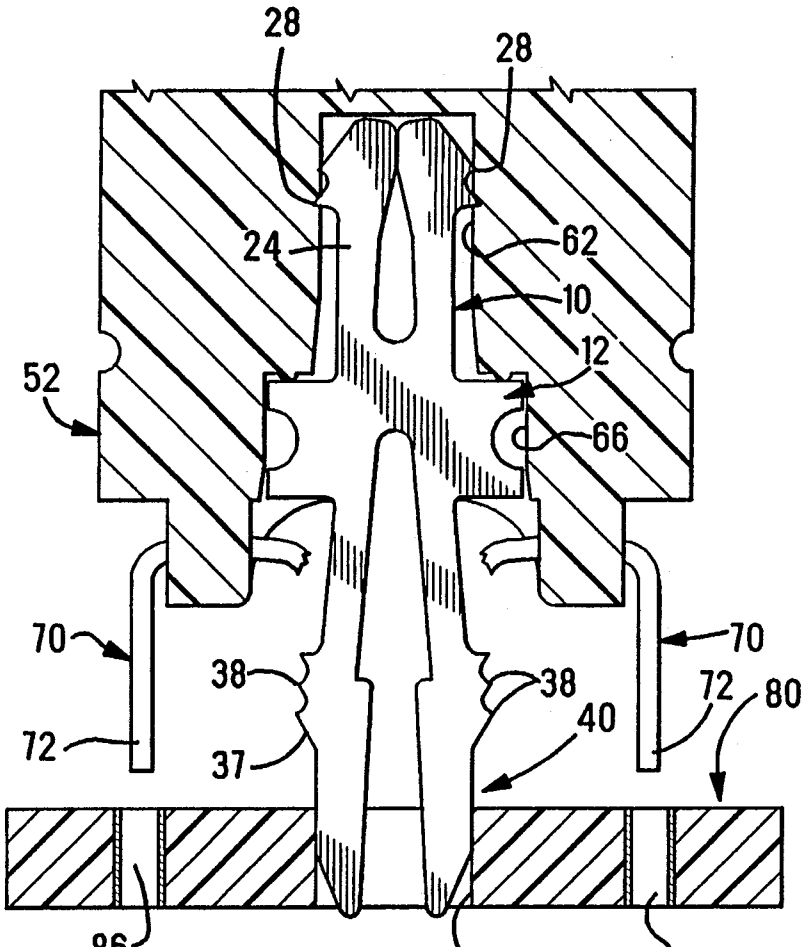
Figure 6:
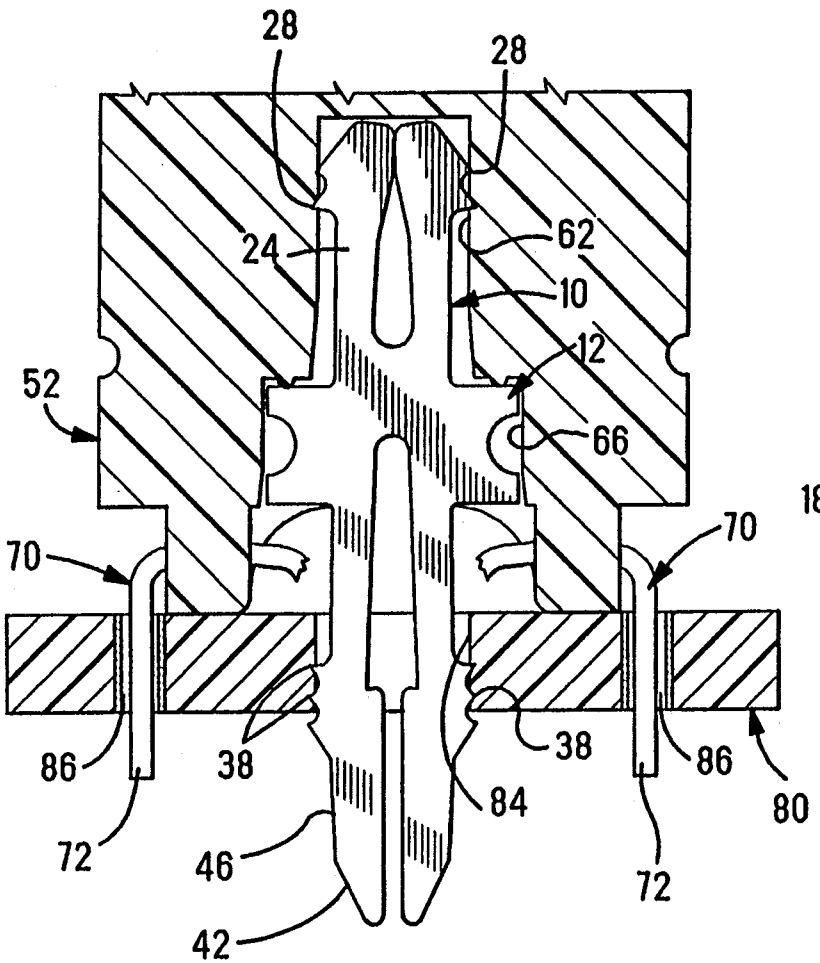

The first pair of cantilevered first beams 20 of device 10 include inner and outer edges 22,24 respectively. Inner surfaces 22 further include a flat portion 26 at the leading end thereof and the outer surfaces 24 include outwardly extending barbs at the outer edges thereof. The pair of first beams 20 are deflectable toward one another and are adapted to be received in a housing cavity 58 as best seen in FIGS. 4 through 6. The connector cavity 58 includes a first portion 60 dimensioned to receive the pair of first beams 20 in interference fit and a second portion 64 dimensioned to receive the body 12 of device 10 such that the body and first portions are disposed within cavity 58. Upon disposing holding device 10 within housing cavity 58, such that the outer side edges 28 of the first beams proximate the first ends thereof bear against the sidewall surfaces to provide retention force within the connector cavity 58. An even greater retention force is achieved when the cavity 58 and device 10 are dimensioned such that upon inserting device 10 into cavity 58 the flat surfaces 26 on first beams 20 abut each other. Body 12 further includes outwardly extensing portions 18 which are received within the appropriately configured second housing cavity portion 66.

The pair of diverging cantilevered second beams 30 of device 10 include inner and outer surfaces 32,34 respectively and further include a wall engaging portion 40 at the leading ends thereof and board engaging portions 36 intermediate ends 40 and body 12. The second beams are deflectable toward one another and are adapted to be received in corresponding retention apertures 84,82 of the circuit board 80 such that the outer edges of the wall engaging portions 40 engage the side wall surfaces 84 of the apertures 82 and are deflected toward each other to guide the connector into position.

In the preferred embodiment holding device 10 is stamped from continuous sheet metal stock of a sufficient thickness and hardness to serve as a holding device by virtue of the barbs 28,38 thereon engaging the interior surface 62,84 of cavity 60 and apertures 82, respectively. Materials such as brass, phosphor bronze or stainless steel may be employed with thickness ranging on the order of 0.012 to 0.025 inches. The dimensions of cavity 58 and board apertures 82 are sufficiently large to allow inward deflection of beams 20 and 36 respectively to provide an elastic spring action holding the respective barbs 28,38 in engagement with the interior surfaces.

In the preferred embodiment two of the devices 10 are used in the connector 50 as shown in FIG. 1. When used at least in pairs, the leading ends 40 of the diverging cantilevered second beams 30 provide aligning features for the connector as illustrated in FIGS. 4 through 6. As can be seen from these Figures when device 10 is fully inserted into cavity 58 of housing 52 the tapered leading ends of the second beams 30 extend below the leading ends 72 of terminal members 70. As the leading ends of beams 30 enter the respective circuit board apertures 84, the lead-in surfaces 42 deflect the cantilevered second beams 30 toward each other such that the flat wall surfaces 46 engage the side walls 84 of the circuit of aperture 82. The flat surfaces 46 ensure that the insertion force is relatively low, preferably less than one pound, prior to the terminal ends 72 engaging their respective terminal receiving apertures 86. The holding devices 10 thereby provide a means for self aligning the connector. As the connector 50 is moved further toward the board 80, as shown in FIG. 5, the leading ends 72 of terminals 70 engage their respective apertures 86 prior to the holding portion 36 of the cantilevered second beams 30 engaging the inner wall surfaces 84 of respective apertures 82. As the connector 50 is fully inserted the tapered surfaces 37 of the barbs 36 aid in deflecting the beams 40 further inwardly until the barbs 36 engage the inner surfaces 84 of hole 82. The insertion and retention forces increase significantly as the connector 50 is fully mounted to the board 80. The amount of deflection in the second beams 30 that occurs during the mounting of the connector 50 to the board 80 varies according to the diameter of the retention aperture 84. The device 10 can accommodate a larger range of aperture sizes than was possible with prior art devices and furthermore provides a more consistent insertion and extraction force owing to the lead-in design and spring characteristics of the diverging beams.

Figure 7:
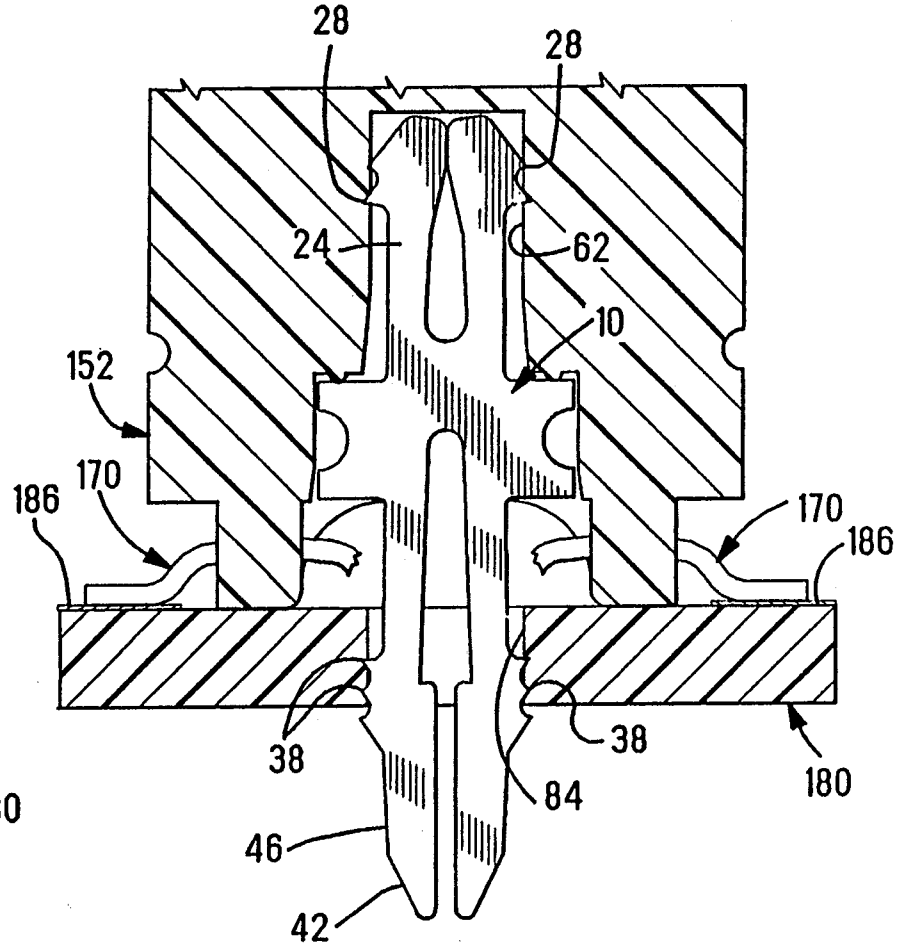
FIG. 7 is a cross-sectional view of the holding device of the present invention used in a connector having terminals that are surface mounted contacts to a board.

FIG. 7 shows a connector 150 having terminals 170 with surface mounted leads 172 for connecting to corresponding circuit pads 184 on board 180. The holding device 10 also aligns the connector 150 and the contact 172 prior to engagement of contacts 172 with circuit pads 184.

It is thought that the electrical connector of the present invention and many of its attendant advantages will be understood from the foregoing description. It is apparent that various changes may be made in the form, construction, and arrangement of parts thereof without departing from the spirit or scope of the invention, or sacrificing all of its material advantages.

We claim:

1. A device for holding an electrical connector to a circuit board, said device comprising:

a one-piece essentially planar metal member including a body having opposed lateral and opposed end edges;

a pair of diverging cantilevered first beams extending outwardly in a first direction in said plane from one of said lateral body edges to first free ends, said pair of first beams being deflectable toward one another and being adapted to be received in a cavity within a housing of said electrical connector, said side edges of said first beams proximate said free ends bearing against side wall surfaces of said cavity and thereby being deflectable toward each other and thereafter exert force against said side wall cavity surfaces defining a holding section for said first electrical connector; and a pair of diverging cantilevered second beams extending outwardly in a second direction in said plane from the other of said lateral body edges to second free ends, each of said pair of second beams including a wall engaging portion at the leading end thereof and a board holding portion intermediate said wall engaging portion and said body, said second beams being deflectable toward one another and being adapted to be received in a corresponding retention aperture of said circuit board, outer edges of said wall engaging portion of said second beams proximate said second free ends bearing against side wall surfaces of said aperture and thereby being deflectable toward each other and thereafter exert force against said side wall aperture surfaces to hold said connector to said board when said connector has been fully mounted to said board.

2. The device of claim 1 wherein said free ends of said second beams extend below ends of terminal leads of said connector such that said second beams in conjunction with second beams of at least one other said device thereby enable said wall engaging portions to engage said side wall surfaces of respective said apertures prior to said terminal lead ends entering respective through-holes of said circuit board, all to provide means for aligning said terminal leads with corresponding terminal receiving apertures of said circuit board.

3. The device of claim 1 wherein outer surfaces of said first beams include barbs for engaging said sidewall surfaces of said cavity of said housing and outer surfaces of said second beams include barbs for engaging said sidewall surfaces of said retention aperture of said circuit board.

4. A self-aligning electrical connector having at least two holding devices for securing said connector to a circuit board, said connector comprising:

a housing having mating and mounting faces and a plurality of electrical terminal members extending therebetween, said terminal members having leads exposed at said mounting face for engaging circuits on said circuit board, said housing further including at least two cavities extending into said housing from the board mounting face thereof, each of said cavities being dimensioned to receive one of said at least two holding devices;

each of said holding device comprising:

a one-piece essentially planar metal member including a body having opposed lateral and opposed end edges, said metal member defining a retention section at a connector-proximate end thereof insertable into and self-retainable within a respective one of said cavities; and a pair of diverging cantilevered beams extending outwardly from a board proximate end of said body in said plane to free ends, each of said pair of beams including a wall engaging portion at the leading end thereof and a board holding portion intermediate said wall engaging portion and said body, said beams being deflectable toward one another and being adapted to be received in a corresponding retention aperture of said circuit board, outer edges of said wall engaging portion of said beams proximate said free ends bearing against side wall surfaces of said aperture and thereby being deflectable toward each other and thereafter exert force against said side wall aperture surfaces to hold said connector to said board when said connector has been fully mounted to said board, said free ends of said wall engaging portions extending a further distance from said housing mounting face than said exposed terminal leads thereby enabling said wall engaging portions to engage said side wall surfaces of said apertures prior to said terminal lead ends entering respective through-holes of said circuit board, all to provide means for aligning said connector and said terminal leads thereof with corresponding terminal receiving apertures of said circuit board.

5. The electrical connector of claim 4 wherein said retention section for securing said device in said connector cavity comprises a pair of diverging cantilevered beams extending outwardly from a housing proximate end of said body and in said plane to free ends, said pair of beams being deflectable toward one another and being adapted to be received in one of said housing cavities, said side edges of said beams proximate said free ends bearing against side wall surfaces of said cavity and thereby being deflectable toward each other and thereafter exert force against said side wall cavity surfaces defining a holding section for said electrical connector.

* * * * *